US006374516B1

(12) United States Patent
Bonaventure et al.

(10) Patent No.: US 6,374,516 B1
(45) Date of Patent: Apr. 23, 2002

(54) BOOT WITH AN ADJUSTABLE LENGTH UPPER ADAPTED FOR SKATING

(75) Inventors: Laurent Bonaventure, Cran Gevrier; Thierry Miralles, Doussard; Raphaël Reiller, Rumilly, all of (FR)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 09/487,988

(22) Filed: Jan. 20, 2000

Related U.S. Application Data

(63) Continuation-in-part of application No. 09/079,856, filed on May 15, 1998, now Pat. No. 6,050,004.

(30) Foreign Application Priority Data

May 16, 1997 (FR) ..... 97 06358
Jan. 21, 1999 (FR) ..... 99 00786

(51) Int. Cl.[7] ..... A43B 5/16

(52) U.S. Cl. ..... 36/115; 36/97; 36/102; 36/10

(58) Field of Search ..... 36/97, 102, 100, 36/105, 8.2, 115, 101, 103, 10, 55

(56) References Cited

U.S. PATENT DOCUMENTS

| | | | | |
|---|---|---|---|---|
| 2,572,050 A | | 10/1951 | Ornstein | 280/11.3 |
| 3,963,252 A | | 6/1976 | Carlson | 280/11.22 |
| 3,997,985 A | * | 12/1976 | Shiina | 36/97 |
| 4,120,103 A | | 10/1978 | Colby | 36/97 |
| 4,136,468 A | | 1/1979 | Munschy | 36/97 |
| 4,408,403 A | | 10/1983 | Martin | 36/115 |
| 4,418,929 A | | 12/1983 | Gray | 280/11.23 |
| 4,704,808 A | | 11/1987 | Bianchini et al. | 36/102 |
| 4,852,275 A | | 8/1989 | Bianchini et al. | 36/102 |
| 5,069,462 A | | 12/1991 | Murga | 280/23 |
| 5,125,172 A | | 6/1992 | Iwama et al. | 36/117 |
| 5,171,033 A | | 12/1992 | Olson et al. | 280/11.22 |
| 5,177,884 A | | 1/1993 | Rullier et al. | 36/117 |
| 5,193,827 A | | 3/1993 | Olson | 280/7.13 |
| 5,276,983 A | | 1/1994 | Hatfield | 36/138 |
| 5,331,752 A | | 7/1994 | Johnson et al. | 36/115 |

(List continued on next page.)

FOREIGN PATENT DOCUMENTS

| | | |
|---|---|---|
| CN | 302731 | 4/1997 |
| DE | 174665 | 9/1906 |
| DE | 29600910 | 3/1996 |
| EP | 0261756 | 3/1988 |
| EP | 0765614 | 4/1997 |
| EP | 0770339 | 5/1997 |
| EP | 0784944 | 7/1997 |
| EP | 0878141 | 11/1998 |
| FR | 2668072 | 4/1992 |
| FR | 2772631 | 6/1999 |
| WO | WO94/21149 | 9/1994 |
| WO | WO96/40391 | 12/1996 |

*Primary Examiner*—Mickey Yu
*Assistant Examiner*—Jila M. Mohandesi
(74) *Attorney, Agent, or Firm*—Greenblum & Bernstein, P.L.C.

(57) ABSTRACT

A skating boot adapted to be affixed to a chassis, the boot including a flexible, at least partially padded upper, shaped to envelope the foot and the lower leg, and a reinforcing portion including at least one rigid sole connected to the chassis and a heel reinforcement. The flexible upper includes a front foot covering portion having a rear scallop at least in the heel zone. A rear cuff, independent of the covering portion, includes a heel enveloping portion and a rising portion to envelope the lower leg. The front foot covering portion and the rear cuff are assembled detachably to form a flexible upper whose length can be adjusted. The boot is adaptable to a variety of sizes and foot morphologies, while ensuring a uniform enveloping and the same level of comfort, regardless of the adjustment length adopted.

20 Claims, 6 Drawing Sheets

U.S. PATENT DOCUMENTS 5,339,543 A 8/1994 Lin ..... 36/101
5,357,695 A * 10/1994 Lu ..... 36/115
5,437,466 A 8/1995 Meibock et al. ..... 280/11.22
5,475,936 A 12/1995 Cavisin ..... 36/115
5,499,461 A 3/1996 Danezin et al. ..... 36/117
5,509,217 A * 4/1996 Condini ..... 36/199
5,566,475 A * 10/1996 Donnadieu ..... 36/55
5,570,523 A * 11/1996 Lin ..... 36/112
5,678,833 A * 10/1997 Olsen ..... 280/11.3
5,794,362 A 8/1998 Polk, III ..... 36/97
5,839,735 A 11/1998 Benoit ..... 280/11.22
5,842,293 A * 12/1998 Young ..... 36/97
5,909,947 A 6/1999 De Marchi ..... 36/50.5
6,045,144 A * 4/2000 Wong ..... 280/11.26
6,050,004 A 4/2000 Miralles et al. ..... 36/97
6,082,027 A * 7/2000 Wagonhurst ..... 36/97
6,101,743 A * 8/2000 Brown ..... 36/102

* cited by examiner 31
60
33b
30
33 a
58
57

31
60
58
33 b
30
33 a
57

31
30
39a
56 a
61
32

61
56 a 32
31
30

BOOT WITH AN ADJUSTABLE LENGTH UPPER ADAPTED FOR SKATING

CROSS-REFERENCE TO RELATED APPLICATION

This application is a continuation-in-part of U.S. patent application Ser. No. 09/079,856, filed on May 15, 1998, now U.S. Pat. No. 6,050,004, issued on Apr. 18, 2000.

BACKGROUND OF THE INVENTION

1. Field of the Invention

The present invention is related to skating devices, such as in-line skates, traditional roller skates, and ice skates. It is specifically related to boots that are adapted to such skates by an adjustment of their length and volume so as to accommodate a wide variety of sizes and foot morphologies.

2. Description of Background and Relevant Information

In-line skating is a sport which has become extremely successful and popular with a growing number of people. A large number of children also like to practice this sport. However, manufacturers generally offer a limited range of children's boots, citing development, manufacturing and budgeting costs as reasons therefor. As a result, it becomes difficult to find a boot which conforms correctly both to the size and the morphology of the child's foot, and at the same time, is comfortable, envelopes the foot and provides a good transmission of supports. In addition, in view of the fact that a child's foot grows both in size and volume, the skates soon become obsolete, usually after only a few months of wear.

Existing solutions consist of adjusting the shell size of the skating boot. U.S. Pat. No. 5,475,936 discloses, for instance, an in-line skate having a shell and a quarter portion assembled on the shell via sliding guide means. Such an assembly provides just a partial solution to the problem because only the reinforcing shell is adjustable in size. Such a shell is provided to receive an inner liner whose configuration has not been envisioned in U.S. Pat. No. 5,475,936.

Consequently, the problem of comfort and enveloping the foot has not been satisfactorily dealt with in the adjustable length/volume skate as disclosed by U.S. Pat. No. 5,475,936. In addition, the skate disclosed in this patent has the disadvantage of being hot, heavy and poorly ventilated, due to its structure which consists of an integrated rigid shell that has been derived from the field of downhill ski boots.

U.S. Pat. No. 5,794,362 discloses an athletic boot whose size can be adjusted. The boot has a molded construction, with a shell base on which a heel portion is adjusted at the rear, and a flexible tongue is adjusted towards the front. A collar is journalled about the heel portion. The adjustment mechanism is completed with straps made of a thermoplastic material that surround the instep in order to adjust its volume. Such a boot is essentially constituted of a rigid shell and has the same disadvantages as those cited in U.S. Pat. No. 5,794,362 in which an inner liner is inserted. The proposed liner is equipped with slits arranged in appropriate areas, such as at the heel and in a frontal longitudinal position, so as to be able to accept variations in the size and volume of the shell. However, this adjustment is achieved at the expense of an adequate enveloping of the foot, and at the expense of comfort.

European Patent Application No. 878 141 A1 filed by the Applicant is related to a multi-sized boot which has a first part forming a cradle for heel retention that is extended by a sole, and a second part forming a more flexible vamp and having a plantar support. The first and second parts are adjusted along a relative, pre-determined longitudinal position and are connected via fixed connecting means. This type of solution is interesting but does not resolve the problem of adjusting the length of a child's skating boot, which includes the padding portion surrounding the foot.

U.S. Patent No. 5,842,293 is also related to a skate whose size can be adjusted. The skate has a boot made of two rigid plastic parts; a vamp portion equipped with lateral slots and a collar portion equipped with lateral buttons adapted to cooperate with the lateral slots. The parts are also equipped with serrated straps whose function is to adjust the width of each part individually, as well as to position the two parts relative to one another. Such a construction is fairly rudimentary and does not enable a very precise adjustment in volume. In addition, there is no mention of how the liner is adapted to the modification in volume of the two relatively rigid parts of the boot. It does not appear that this type of construction would guarantee comfort.

SUMMARY OF THE INVENTION

It is an object of the this invention to solve the aforementioned problems. In particular, the invention proposes a boot that is adaptable to a variety of sizes and foot morphologies, while ensuring uniform enveloping and the same degree of comfort, regardless of how long an adjustment was made.

In order to achieve this as well as other objects, the inventive process envisioned the design of a flexible upper, including padding, constituted of two especially configured, detachably assembled parts, so as to promote an adjustment relative to the enveloping of the foot without risking any discomfort, creases, uncovered areas, etc.

More specifically, the invention is related to a skating boot, that can be adapted on a chassis, the chassis having:

- a flexible upper whose shape is adapted to envelope the foot and the lower leg;
- a reinforcing portion having at least one rigid sole connected to the chassis and a heel reinforcement, wherein:
  - the flexible upper has a front foot covering portion with a rear scallop freeing at least the heel zone; and
  - a rear cuff, independent of the covering portion, includes a heel enveloping portion and a rising portion for enveloping the lower part of the leg;
  - the front foot covering portion and the rear cuff being detachably assembled to form a flexible upper whose length can be adjusted.

In particular, the cuff is used like a frame of reference for positioning the leg, while the covering portion is displaced during adjustment with respect to such frame of reference.

According to another characteristic, the cuff has lateral cut out edges that free the area of the malleoli. Indeed, the area of the malleoli has been identified as being a sensitive zone that is not very tolerant of overthicknesses. Thus, the object of the invention is to cover the area of the malleoli with the covering portion within a predetermined range of adjustment that corresponds to the useful range of adjustment, so as to provide a uniform level of comfort.

According to a complementary characteristic, the front foot covering portion and the rear cuff are assembled by overlapping two sole thicknesses whose rigidity is greater than the rigidity of the remainder of the upper; the overlapping length can be modified depending on the desired adjustment of the upper. Such an assembly is simple and reliable. Because of its rigidity, the overlapping ensures a good retention and good support for the plantar support in the given zone.

According to another characteristic, the front foot covering portion and the rear cuff are, in addition, assembled by at least the partial overlapping of the lateral parts of each of the portions, which together delineate the volume of the flexible upper. Thus, the width of the foot can be adjusted by overlapping the lateral parts of the upper. This overlapping also ensures a good retention of the front foot portion and the cuff together. It also ensures a continuous enveloping of the foot without any non-covered zones that could cause discomfort in a localized manner.

According to an advantageous embodiment characteristic, the front foot covering portion has a sole portion and a vamp portion connected to the sole portion; the sole portion has a rigid tongue extending the sole portion towards the rear, beyond the vamp portion; the tongue having the ability to get housed during overlapping, at least partially, in the sole portion of the rear cuff. Such an assembly allows for a simplified adjustment of length that can be implemented without any great difficulty.

According to another interesting characteristic, the reinforcing portion has a first sub-assembly forming a rigid cradle that includes the heel reinforcement, which is affixed to the rigid sole; and a relatively more flexible, second sub-assembly, constituting a front foot covering vamp and having a plantar support; this plantar support being nested in the cradle and being connected thereto in a pre-determined longitudinal position that can be adjusted via adjustment and detachable connecting means arranged between the first and the second sub-assembly; the flexible upper being inserted inside the volume defined by the first and second sub-assemblies.

As a result, this simultaneously provides an adaptation of the reinforcing portion, as well as an adaptation of the enveloping portion, or flexible padded upper. This dual adaptation is unique as compared to the state of the art. It provides the possibility of adjusting, concomitantly, the characteristics relative to the transmission of forces and relative to safety, as well as the characteristics relative to the perception of sensations, proprioceptive properties and comfort.

BRIEF DESCRIPTION OF THE DRAWINGS

The instant invention also has other advantageous characteristics that will become apparent from the following description, provided by way of example, and in which.

DETAILED DESCRIPTION OF THE INVENTION

Figure 1:
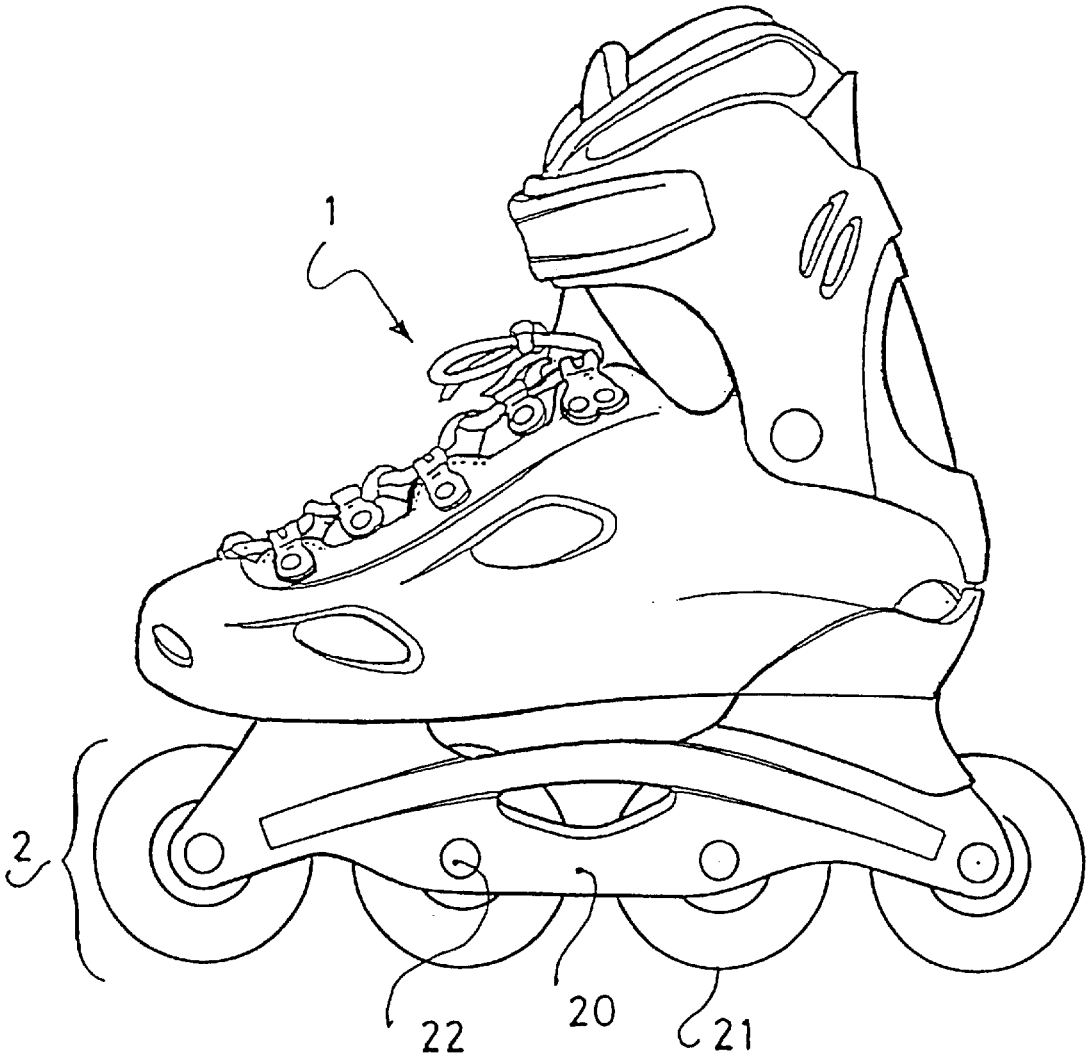
FIG. 1 is a side view of an in-line skate with a boot according to the invention.

The in-line skate illustrated in FIG. 1 has a boot 1 and a rolling train 2 along which the boot is secured, either permanently, or detachably via appropriate connecting means (not shown).

The rolling train therefore has a chassis or frame 20, generally with a inverted U-shaped section and a series of wheels 21 which are connected between the sides of the chassis via transverse axes 22 that are aligned in a substantially horizontal series.

Figure 2:
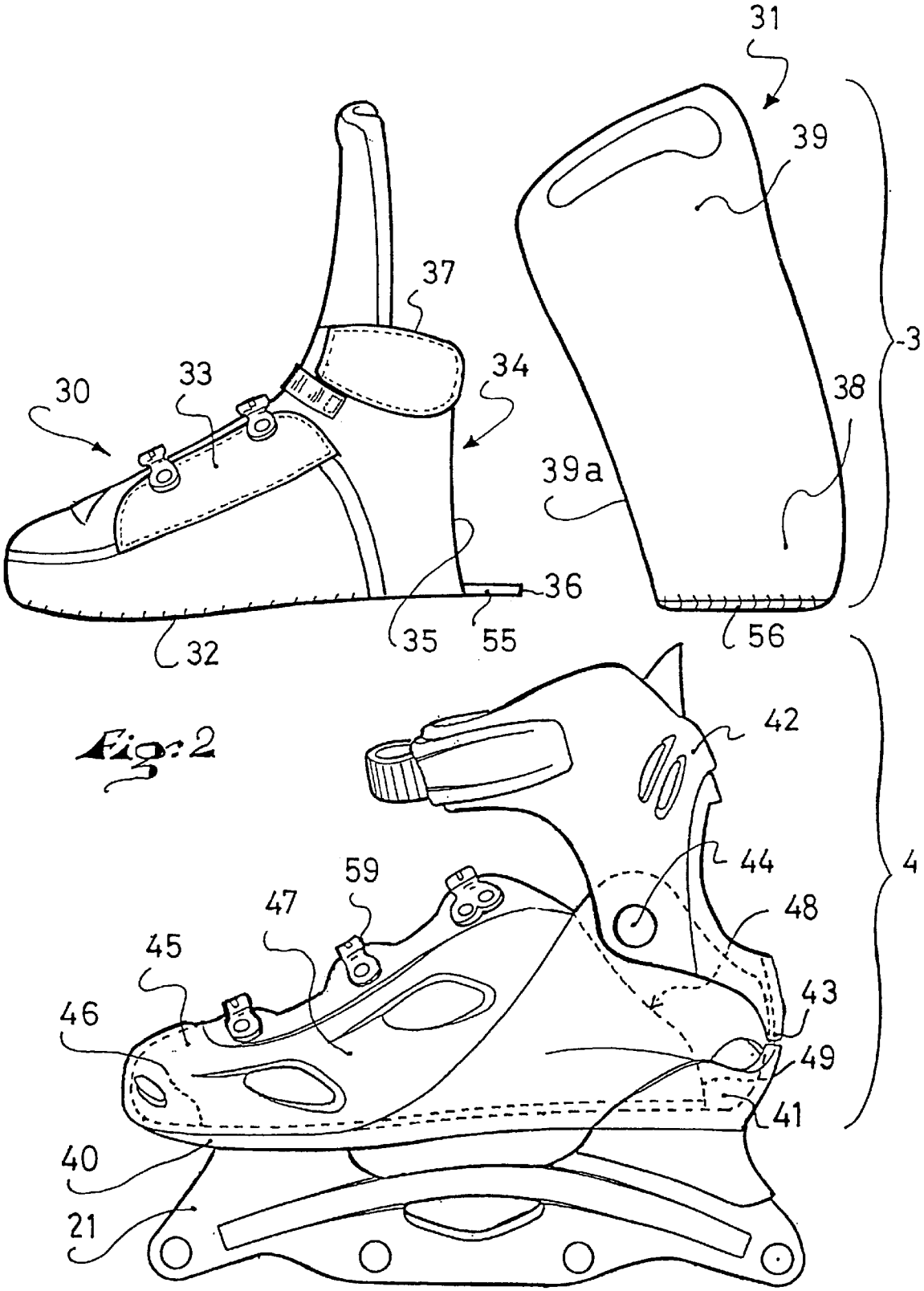
FIG. 2 is an exploded side view of the skate of FIG. 1.

As shown in a first example of FIG. 2, the boot is characterized by a flexible and pliable upper portion 3 and a reinforcing portion 4. The main function of the upper is to promote the enveloping and comfort of the foot as well as the lower part of the user's leg. It is mainly obtained by assembling layers of breathable, light and wear resistant materials. The inside of the upper has a padding.

The flexible upper 3 according to the invention has two parts that are assembled together in order to ensure the adaptation of the upper to the size and morphology of a variety of feet. One of these parts is designed to be the covering portion 30 for the front of the foot, i.e., the forefoot. The other part 31 is constituted of a rising cuff, independent of the covering portion 30.

The front foot covering portion 30 has a sole portion 32 and a vamp portion 33 which is connected to the sole portion 32 via connecting means, such as stitching, for example. The vamp portion extends towards the front to receive the toes and towards the rear, approximately up to the area of the malleoli. The covering portion is equipped with a rear scallop 34. The scallop 34 is delineated by the upwardly extending lateral edges 35 of the vamp and by the rear edge 36 of the sole. The scallop forms a non-covered zone of the front foot covering portion, and corresponds substantially to the heel area of the foot, i.e., the lateral edges are positioned forwardly of the heel area of the foot. In the vertical direction, the upper edges 37 of the vamp portion form the upper limit of the covering portion. Preferably, the covering portion is a relatively low portion of the upper that ends below the area of the malleoli.

The cuff 31 forms the complementary portion overlapping the rear scallop 34 of the foot covering portion. The cuff has a heel enveloping part 38 that extends upwardly via a lower leg enveloping portion 39. The cuff also has a heel support sole 56. The cuff has truncated lateral edges 39*a* and a truncated sole edge 38*a*. In a first example, the lateral edges 39*a* flare progressively upwards, ensuring a good enveloping for the lower part of the calf. Compared to the upper edges 37 of the covering portion, the cuff extends the upper upwardly beyond such edges.

The reinforcing portion 4 has a first sub-assembly or rigid cradle with a rigid outer sole 40 that constitutes the rigid base along which the chassis 20 of the skate is connected, which extends upwardly into the rear region via a heel reinforcement 41 whose dimensions and shape are adapted to maintain and protect the heel. In a potential variation, the chassis can be made all in one piece with the sole 40. A collar 42 is journalled on the heel reinforcement 41. As is well known, the collar ensures the lateral support of the ankle and the lower leg. Preferably, it has a rear abutment 43 that takes support on a complementary support surface of the reinforcement 41 so as to act like a rear support for the leg and like a referencing means that encourages the quest for rear balance. The collar is preferably journalled about transverse journal axes 44 located on the side of the collar in the area of the malleoli.

In a variation (not shown), the collar can be obtained all in one piece with the heel reinforcement 41 and weak section areas can be envisioned to allow the collar to bend with respect to the reinforcement.

A semi-rigid overlapping vamp 45 is provided in the front foot, that is assembled to the sub-assembly formed by the rigid sole 40 and the reinforcement 41. The assembly is obtained in an adjustable manner as will be explained later. The vamp 45 has a plantar support 46 shown in dotted and dashed lines in FIG. 2, and rests on the inner surface of the rigid sole 40. The vamp 45 has lateral portions 47 extending from the area of the toe of the boot up to the vicinity of the heel area, however, with a rear opening 48 in the heel so that the vamp ends in the lateral edges 49 adjacent to the walls of the heel reinforcement 41.

The vamp 45 is adapted to be partially nested in the heel reinforcement 41 by the plantar support 46 and the lateral portions 47 that partially overlap with the heel reinforcement 41 and the rigid outer sole 40.

Figure 3:
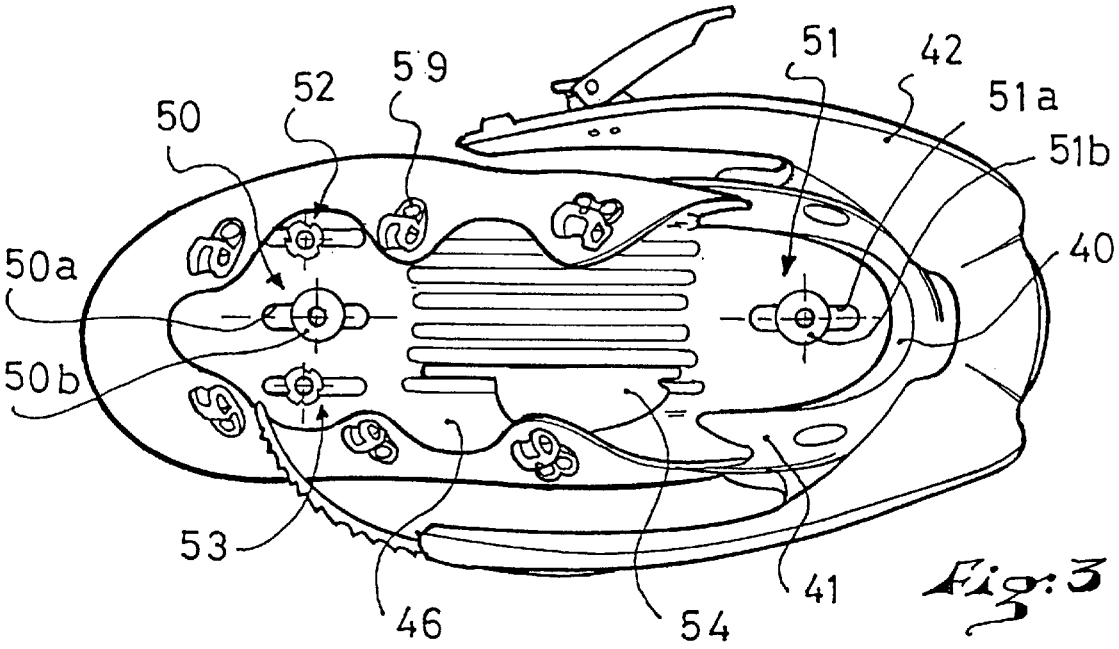
FIG. 3 is a top view of the shell portion that receives the skate according to the invention.

As shall be shown in greater detail in FIG. 3, the plantar support 46 is engaged in the cradle of the reinforcing portion 4 by being connected via detachable connecting and adjustment elements 50, 51, 52, 53 arranged between the rigid outer sole 40 of the cradle and the plantar support 46. The connection and adjustment elements 50, 51 each have a longitudinal slot 50*a*, 51*a* in the plantar support and a screw 50*b*, 51*b* that passes through the slot, from the outer sole and the chassis 20 with which they form common connecting elements. Preferably, the elements 50, 51 are located substantially in the longitudinal axis of the chassis.

Other additional adjustment elements can be added, such as the elements 52, 53, of the same type as the elements 50, 51, but off-centered with respect to such elements. In a different manner as compared to the elements 50, 51, the elements 52, 53 only connect the vamp to the cradle, without any connection with the chassis.

Other variations can be envisioned in which only the connections 50, 51 are present, or only the connections 52, 53.

During the adjustment, the vamp 45 is apt to become deformed in a transverse direction so as to be adapted to the transverse dimensions of the cradle due to the deformation zones or the least resistance zones 54. These zones are preferably obtained in the plantar support 46 of the vamp in the zone corresponding to the range of overlapping with the heel reinforcement surfaces. These zones form longitudinally oriented deformable slots that allow an elastic deformation of the plantar support in the cradle.

Figure 6:
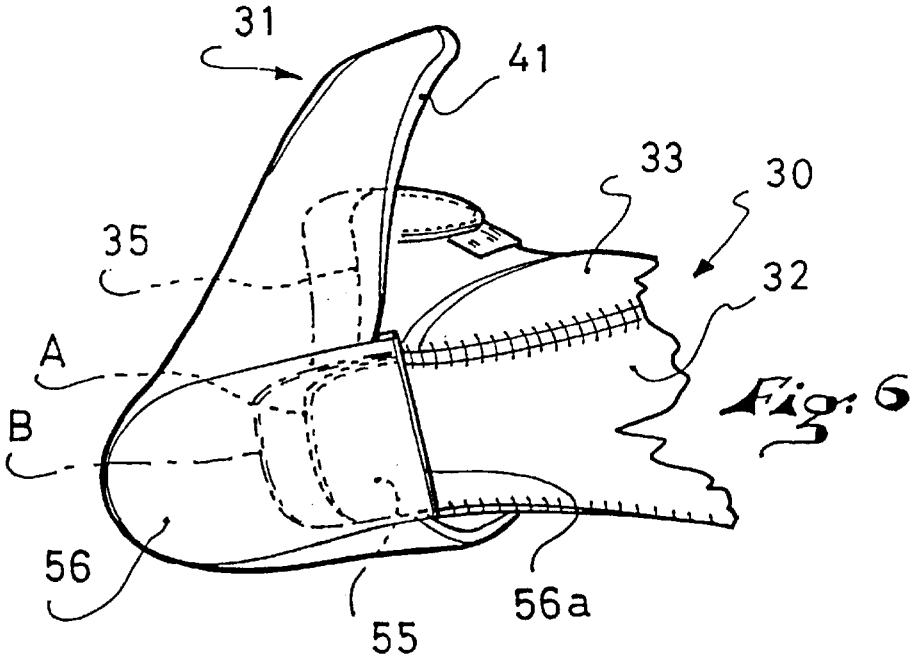
FIG. 6 shows a bottom detail of the upper of FIG. 4.
Figure 4:
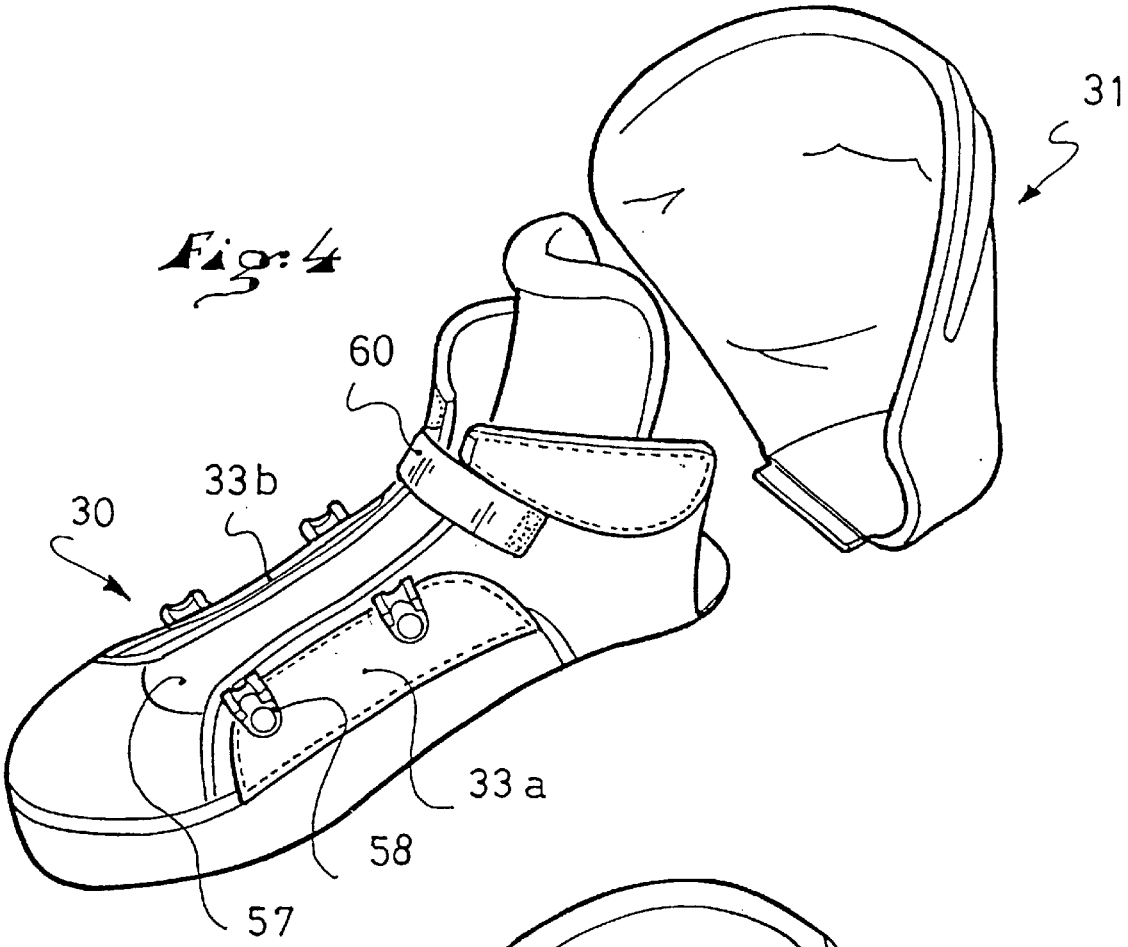
FIG. 4 is an exploded perspective view of the flexible upper according to the invention.
Figure 5:
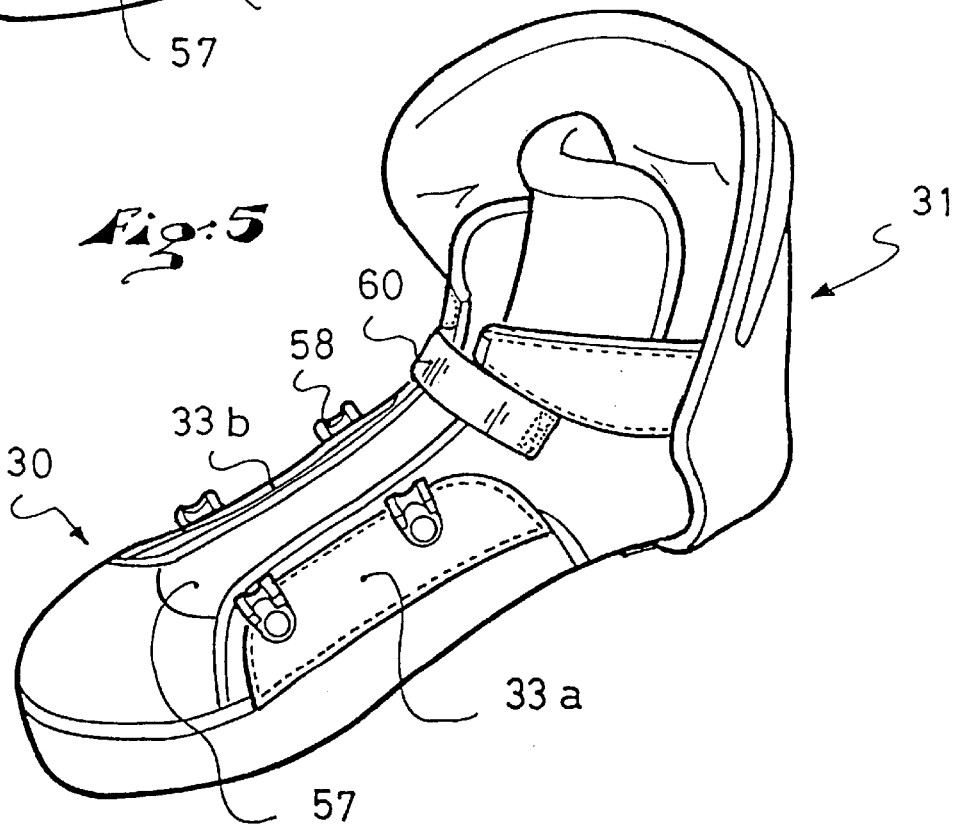
FIG. 5 is a perspective view of the upper in its assembled configuration.

FIGS. 4 through 6 show the details of the assembly formed by the padded flexible upper adapted to cover the foot and the lower leg in a first embodiment of the invention. The sole portion 32 of the covering portion 30 has a rigid tongue 55 that extends the sole portion towards the rear, beyond the vamp portion 33. The tongue can be housed during overlapping in the sole portion 56 of the rear cuff 31. Preferably, the tongue rests inside the sole portion 56 of the cuff, such that the edge 56*a* of the cuff passes under the sole portion 32 of the front foot covering portion 30. The tongue is obtained from a relatively rigid material as compared to the rest of the upper so as to ensure a certain retention of the assembly during bending and in torsion. The sole portion is also preferably obtained in a relatively rigid material as compared to the rest of the upper.

In one embodiment, the lateral edges 39*a* externally overlap the edges 35 of the vamp. In other words, the overlapping occurs by the adjustment of the front foot covering portion 30 inside the cuff 31. FIG. 6 shows, by way of example, a widened adjustment position A and a more narrowed position B.

The upper is adapted to be housed in the reinforcing portion. More specifically, the flexible covering portion 30 of the upper is positioned inside the space formed by the adjustable assembly of the outer sole 40 of the cradle and the independent vamp 45. Similarly, the flexible rear cuff is positioned inside the volume reserved by the heel reinforcement 41 and the collar 42. It is easy to understand that this finely tuned adjustment of the boot is rendered possible due to superpositioning the adjustments, in length and in volume, both for the outer reinforcing portion, as well as for the inner liner.

The structure of the covering portion can include, in its vamp portion 33, two flaps 33*a*, 33*b* that delineate a central opening 57 for the introduction of the foot. Return elements 58 are fixed on the flaps in the vicinity of the edges of the opening 57 for the passage of a lacing (not shown). The return elements 58 can cooperate via an alternating crosswise tightening of the lacing with the return elements 59 connected to the vamp of the reinforcing portion (FIG. 3). Such a lacing device has been described in European Patent Application No. 784 944 whose description is hereby incorporated into this application with reference thereto. An elastic strip 60 is also adjusted at the level of the instep to encourage the introduction of the covering portion 30 in the cuff 31 by exerting a tightening action on the edges of the opening 57.

Figure 7:
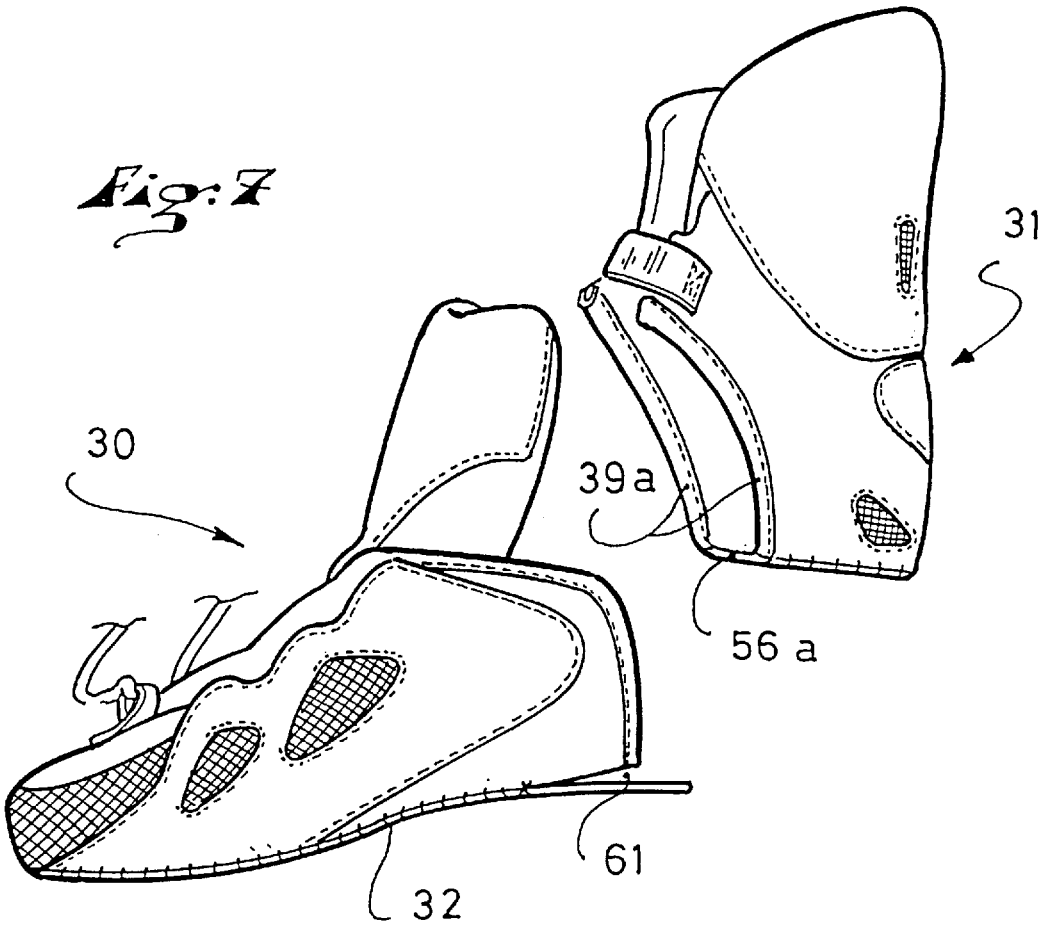
FIG. 7 is an exploded perspective view of a flexible upper according to a variation of the invention.
Figure 8:
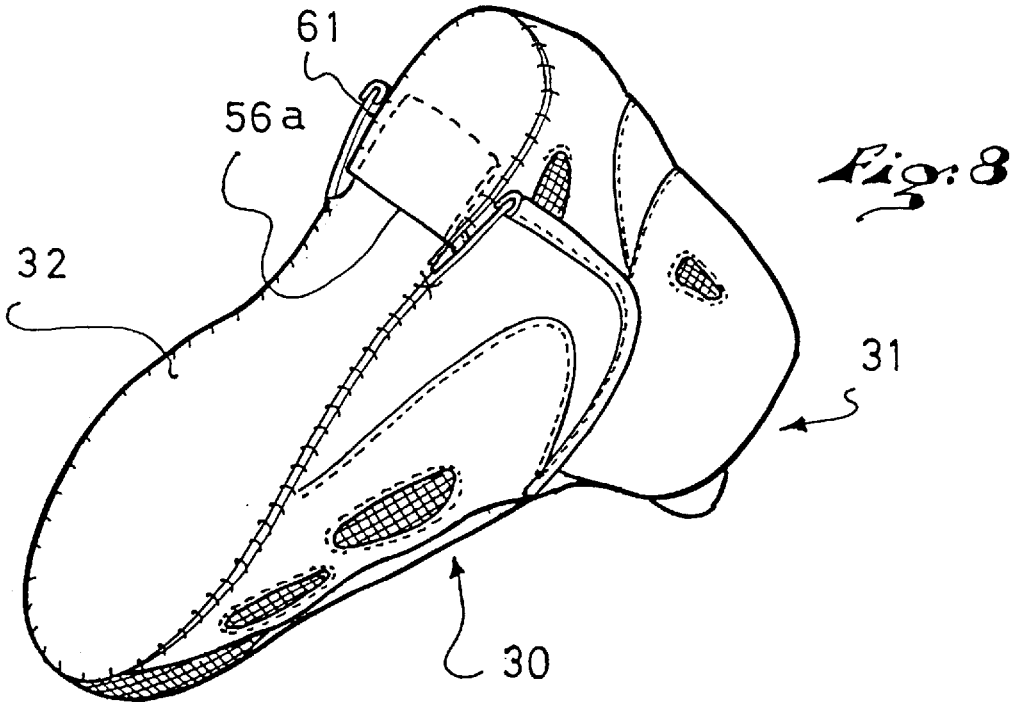
FIG. 8 is a bottom perspective view of the variation of FIG. 7.

FIGS. 7 and 8 illustrate a different embodiment of the invention in which the flexible upper 3 is adjusted lengthwise via a cuff 31 whose lateral edges 39*a* are introduced inside the front foot covering portion 30, whereas the edge 56*a* of the cuff sole is kept outside the covering portion 30, and the sole portion thus forms the external heel support in the cradle. To increase the range of mutual overlap of the two portions 30, 31, the front foot covering zone 30 is equipped with an open edge portion 61 located on each side between the sole portion 32 and the vamp portion 33. Thus, the edges of the cuff can be introduced through the open portions 61, thereby improving retention during the mutual overlapping of the two parts of the upper 30, 31.

Figure 9:
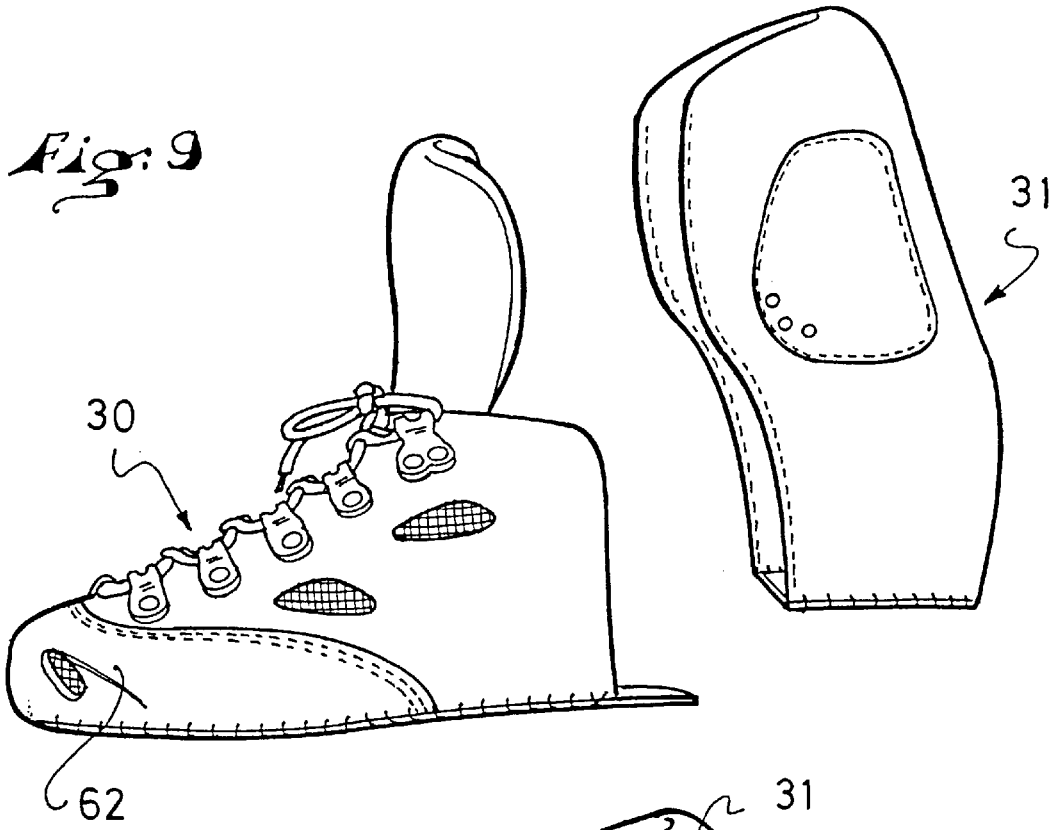
FIG. 9 is an exploded perspective view of a second variation of the invention.
Figure 10:
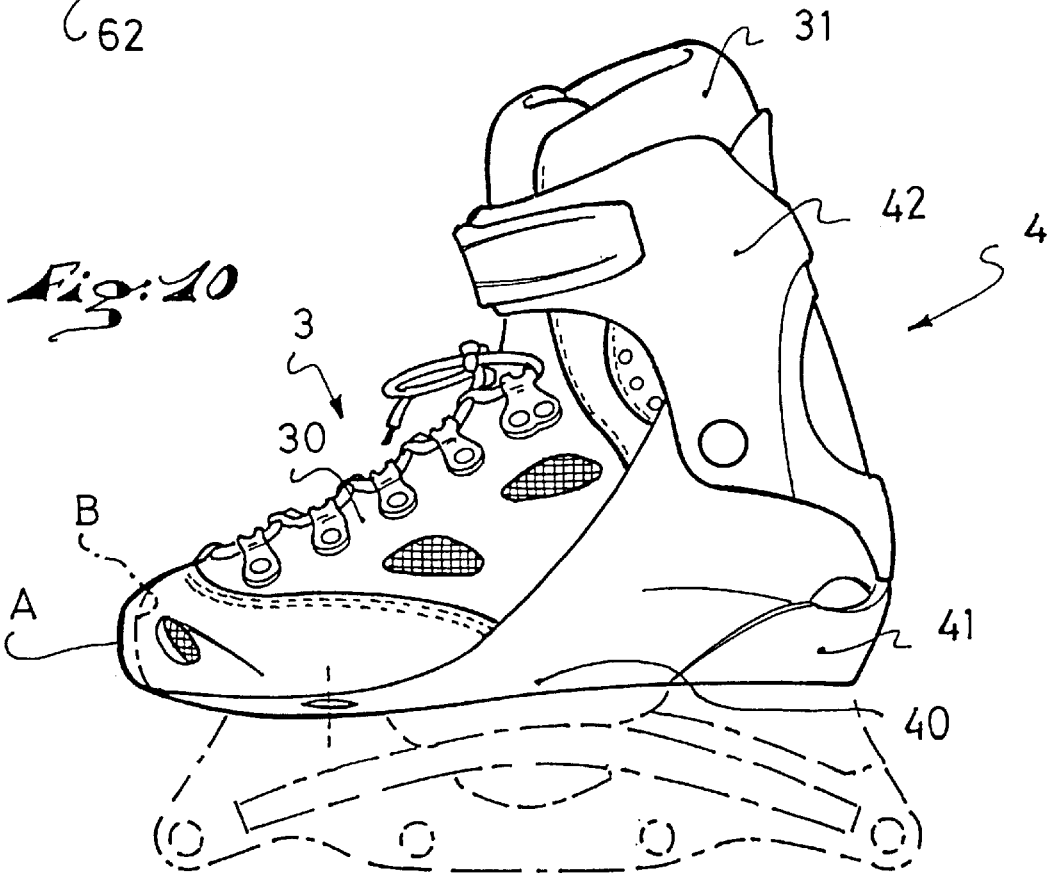
FIG. 10 is a side view showing a boot assembled according to the variation of FIG. 9.

FIGS. 9 and 10 represent another embodiment of the invention in which the covering portion 30 of the upper forms the outer part of the boot in the front foot area in the absence of a plastic vamp. A minimal toe reinforcement is ensured simply via a semi-rigid plastic joining piece 62 that is directly connected to the covering portion 30 via stitching. The advantage of such a boot structure is that it is lighter and breathes better than the aforementioned structure.

In a departure from the previous embodiments, the upper must be connected to the reinforcing portion 4 by connecting elements whose object is to keep the upper in place when the foot is biased while in use. These elements should be detachable so as follow the lengthwise adjustment of the upper. One can thus envision that the front foot covering portion 30 is adjustably and detachably connected directly on the outer sole 40, the elements being of the type described in FIG. 3. One can thus envision that the lengthwise and volume adjustment of the foot can be done by the relative displacement of the front foot 30 covering portion and the cuff 31, used as a frame of reference in the boot, and consequently, with respect to the rigid sole 40, between a position A and a position B such as illustrated in FIG. 10.

As other potential embodiment variations, one can envision that the elements of the flexible upper, i.e., the front foot covering portion 30 and its cuff 31 be assembled via special detachable elements, such as a self-gripping mechanism of the Velcro type (i.e., hook and loop fasteners), for example, or even via strap and buckle assemblies, or even clipping or clicking means.

The thrust of the invention can be found in the arrangement of the upper or flexible and at least partially padded liner, constituted of a first portion covering the front foot and displaceable relative to a second portion forming a cuff, that in turn constitutes the frame of reference for the positioning of the upper with respect to the reinforcement structure of the boot. More specifically, the invention can be found in the combination of an upper having an adjustable configuration, inserted into a reinforcing portion which is itself adjustable.

Naturally, the instant invention is not limited to the aforementioned embodiment examples, but encompasses all embodiments that could be included in the following claims.

The instant application is based upon French Patent Application No. 99 00786, filed on Jan. 21, 1999, the disclosure of which is hereby incorporated by reference thereto in its entirety, and the priority of which is hereby claimed under 35 USC 119.

What is claimed is:

1. A skating boot adapted to be affixed to a skate chassis, the boot comprising:

a flexible, at least partially padded upper, shaped to envelope the foot and the lower leg;

a reinforcing portion comprising at least one rigid sole and a heel reinforcement, the rigid sole to be connected to the chassis, said flexible upper comprising a liner of said reinforcing portion;

the flexible upper comprising a front foot covering portion having a rear scallop at least in the heel zone; and a rear cuff, independently movable with respect to the covering portion, comprising a heel enveloping portion and a rising portion to envelope the lower leg, the rear cuff extending forwardly to lateral edges, the lateral edges extending upwardly, one of the rear cuff and the fore-foot covering portion overlapping the other, whereby the lateral edges of the rear cuff are positioned forwardly of the lateral edges of the fore-foot covering portion;

the front foot covering portion and the rear cuff being assembled to form a flexible upper whose length can be adjusted.

2. A boot as defined by claim 1, wherein the cuff comprises lateral edges cut out to free the area of the malleoli, which is overlapped by the covering portion within a range of adjustment having a pre-determined length.

3. A boot as defined by claim 1, wherein the front foot covering portion and the rear cuff are assembled by overlapping two sole portion thicknesses whose rigidity is greater than the rigidity of the rest of the upper; the overlapping length is capable of being modified according to the adjustment desired for the upper.

4. A boot as defined by claim 2, wherein the front foot covering portion and the rear cuff are, in addition, assembled by at least the partial overlapping of the lateral parts of each of said portions that together delineate the volume of the flexible upper.

5. A boot as defined by claim 3, wherein the front foot covering portion comprises a sole portion and a vamp portion connected to the sole portion; the sole portion having a rigid tongue extending the sole portion towards the rear beyond the vamp portion; the tongue being at least partially housed during the overlapping of the rear cuff in the sole portion.

6. A boot as defined by claim 1, wherein the reinforcing portion comprises a first sub-assembly forming a rigid cradle comprising the heel reinforcement, which is affixed to the rigid sole, and a second sub-assembly, relatively more flexible, constituting a front foot covering vamp and comprising a plantar support, said plantar support being nested in the cradle and being connected thereto in a pre-determined longitudinal position by means of detachable connecting elements arranged between the first and second sub-assemblies to allow longitudinal adjustment within a range of positions, the flexible upper being inserted within the volume defined by the first and second sub-assemblies.

7. A boot as defined by claim 6, wherein the vamp comprises deformable weak zones allowing its nesting in the cradle.

8. A boot as defined by claim 7, wherein the deformable weak zones are constituted of longitudinal slots arranged in the plantar support allowing a deformation thereof during its passage in the cradle at the moment of nesting.

9. A boot as defined by claim 6, wherein the adjustment and detachable connecting elements comprise at least one assembly formed by an elongate slot oriented longitudinally in the plantar support and by a screw passing through the elongate slot and into the rigid sole of the cradle.

10. A boot as defined by claim 9, wherein the adjustment and detachable connecting elements form common connecting elements for the boot on the chassis.

11. A skate comprising a boot affixed to a skate chassis, said skate comprising:

a chassis having a plurality of wheels mounted for rotation;

a boot comprising:

a reinforcing portion comprising at least a rigid sole and a heel reinforcement, said sole connected to said chassis;

a flexible liner of said reinforcing portion, said flexible liner comprising at least a partially padded upper, shaped to envelope the foot and the lower leg, said upper of said flexible liner comprising:

a fore-foot covering portion extending rearwardly to upwardly extending lateral edges forward of a heel area of the boot;

a rear cuff, independently movable with respect to said forefoot covering portion, said rear cuff comprising a heel enveloping portion and a rising portion to envelope the lower leg, said rear cuff extending forwardly to lateral edges, said lateral edges extending upwardly, one of said rear cuff and said fore-foot covering portion overlapping the other, whereby said lateral edges of said rear cuff are positioned forwardly of said lateral edges of said fore-foot covering portion, said fore-foot covering portion and said rear cuff thereby forming a length-adjustable flexible upper.

12. A skate according to claim 11, wherein:

said lateral edges of said rear cuff extend upwardly and forwardly.

13. A skate according to claim 11, wherein:

said rear cuff extends upwardly above an ankle area of the boot.

14. A skate according to claim 11, wherein:

said reinforcing portion of said boot is length-adjustable, said length-adjustable reinforcing portion comprising:

a rigid cradle comprising said rigid sole and said heel reinforcement;

a vamp having a plantar support, said plantar support being nested in said rigid cradle in a determinate longitudinal position with respect to said rigid cradle within a range of longitudinal positions, said plantar support being connected to said rigid cradle with adjustable connecting elements.

15. A skate according to claim 11, wherein:

said reinforcing portion further comprises a vamp extending above said rigid sole;

said flexible upper is positioned within said vamp and comprises an inner liner of said vamp.

16. A skate according to claim 15, further comprising:

a collar mounted for longitudinal movement with respect to said heel-reinforcement, said collar extending above an ankle portion of the boot to provide lateral support to a user's ankle and lower leg.

17. A skate according to claim 11, wherein:

said vamp includes deformable weakened zones allow said plantar support to be nested within said rigid cradle.

18. A skate according to claim 17, wherein:

said deformable weakened zones comprise longitudinally elongated slots extending through said plantar support of said vamp.

19. A skate according to claim 11, wherein:

said flexible upper has a toe reinforcement connected to said fore-foot covering portion;

said fore-foot covering portion of said flexible upper is connected directly to said rigid sole of said reinforcing portion with adjustable connecting elements to facilitate length-wise adjustment of said flexible upper.

20. A skating boot adapted to be affixed to a skate chassis, the boot comprising:

a flexible, at least partially padded uppers shaped to envelope the foot and the lower leg;

a reinforcing portion comprising at least one rigid sole and a heel reinforcement, the rigid sole to be connected to the chassis, said flexible upper comprising a liner of said reinforcing portion;

the flexible upper comprising a front foot covering portion having a rear scallop at least in the heel zone; and a rear cuff, independently movable with respect to the covering portion, comprising a heel enveloping portion and a rising portion to envelope the lower leg;

the front foot covering portion and the rear cuff being assembled to form a flexible upper whose length ea be adjusted;

wherein the front foot covering portion and the rear cuff are assembled by overlapping two sole portion thicknesses whose rigidity is greater than the rigidity of the rest of the upper, the overlapping length being capable of being modified according to the adjustment desired for the upper, and wherein the front foot covering portion comprises a sole portion and a vamp portion connected to the sole portion, the sole portion having a rigid tongue extending the sole portion towards Fe rear beyond the vamp portion, the tongue being at least partially housed during the overlapping of the rear cuff in the sole portion.

* * * * *